US005634814A

United States Patent [19]

Krivec

[11] Patent Number: 5,634,814

[45] Date of Patent: Jun. 3, 1997

[54] SIMPLIFIED CABLE ATTACHMENT AND JAW FOR CABLE CLAMP

[75] Inventor: Bert Krivec, Waukesha, Wis.

[73] Assignee: Snap-on Technologies, Inc., Lincolnshire, Ill.

[21] Appl. No.: 452,394

[22] Filed: May 26, 1995

[51] Int. Cl.[6] ..... H01R 4/24

[52] U.S. Cl. ..... 439/441; 439/729; 439/754; 439/504

[58] Field of Search ..... 439/438–441, 439/835, 836, 502, 505, 504, 506, 868, 883, 754, 755, 729

[56] References Cited

U.S. PATENT DOCUMENTS 4,722,579 2/1988 Cummings et al. ..... 439/441

4,892,488 1/1990 Nestor et al. ..... 439/441

*Primary Examiner*—David L. Pirlot

*Attorney, Agent, or Firm*—Emrich & Dithmar

[57] ABSTRACT

A cable attachment apparatus for attaching a cable conductor having an outside diameter to a booster cable clamp is provided. The apparatus includes a generally tubular wall defining a receptacle for receiving the cable conductor. The tubular wall has an inside diameter slightly greater than the outside diameter of the cable conductor. The apparatus further includes a plurality of fingers circumferentially and axially spaced about the wall, wherein each finger is closest in the axial direction to another finger disposed at a different circumferential position on the wall.

20 Claims, 1 Drawing Sheet

SIMPLIFIED CABLE ATTACHMENT AND JAW FOR CABLE CLAMP

BACKGROUND OF THE INVENTION

1. Field of the Invention

The present invention relates to a cable attachment device, and more particularly, to cable attachment devices for battery or booster cable clamps.

2. Description of the Prior Art

Cables have been attached in the past to battery or booster cable clamps by an attachment device permanently attached to one of the levers of the clamp. These attachment devices included a housing originally larger in cross-sectional area than the conductor portion of the cable. The cable was retained in the device by inserting the cable conductor portion into the housing and then crimping the device down to increase contact between the cable and device to retain the cable within the device. This process was slow, required two steps and was not suitable for automated assembly.

In addition, if the cable now attached to the clamp became damaged, the cable could not simply be replaced because the cable could not be removed from the attachment device without destroying the device's ability to grip and retain a new cable.

SUMMARY OF THE INVENTION

It is a general object of the present invention to provide a cable attachment device, which avoids the disadvantages of prior devices while affording additional structural and operating advantages.

An important feature of the invention is the provision of an attachment device which allows quick and easy insertion and retention of a cable.

Another feature of the invention is the provision of an attachment device which allows a cable previously inserted in the device to be removed from the device and another to be inserted into the device without destroying the device.

A still further feature of the invention is the provision of an attachment device which has the ability to provide improved electrical connection to a cable conductor with little or no damage to the cable conductor wires.

Another feature of the present invention is the provision of an attachment device which is of simple and economical construction.

These and other features of the invention are attained by providing an attachment apparatus for attaching a cable conductor having an outside diameter to a booster cable clamp. The apparatus comprises a generally tubular wall defining a receptacle for receiving the cable conductor. The receptacle has an inside diameter slightly greater than the outside diameter of the cable conductor. The apparatus further includes a plurality of fingers circumferentially and axially spaced about the wall wherein each finger is closest in the axial direction to another finger disposed at a different circumferential position on the wall.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
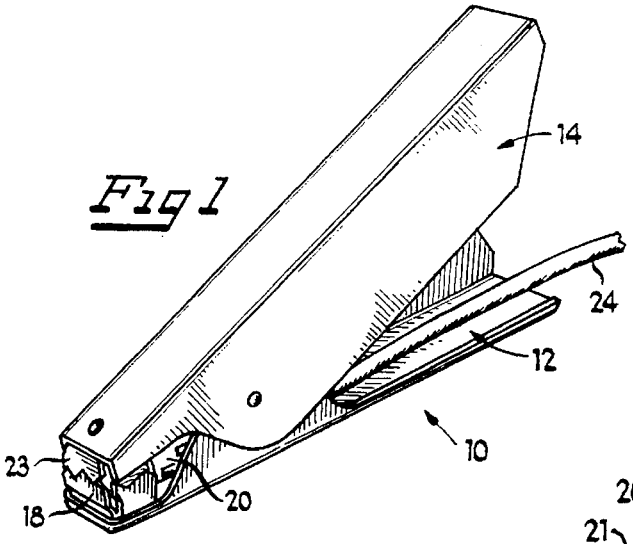
FIG. 1 is a perspective view of a booster cable clamp embodying an attachment device of the present invention.
Figure 2:
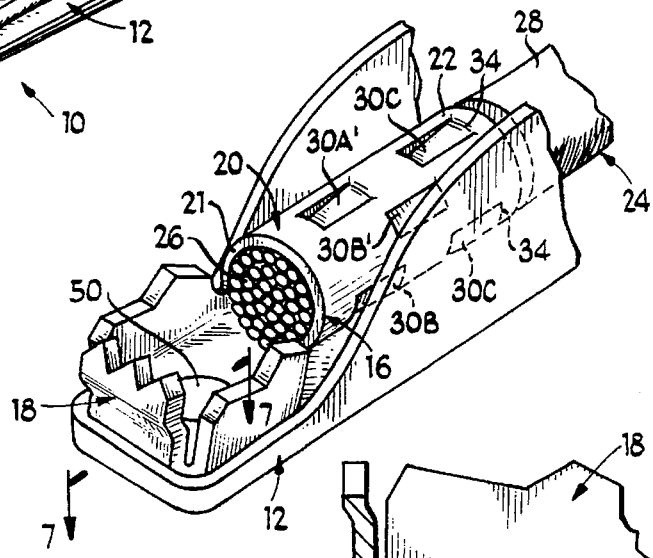
FIG. 2 is an enlarged, fragmentary perspective view of one lever of the clamp of FIG. 1 showing the cable attachment device.

A booster or battery cable clamp 10 is illustrated in FIG. 1. The clamp 10 includes a first lever 12 pivotally connected to a second lever 14, and biased by means not shown to the illustrated closed position, all in a known manner. Connected to the first lever 12, as described below, is a jaw and cable attachment device 16. Referring to FIG. 2, the Jaw and cable attachment device 16 includes a jaw portion 18 integral with a tubular wall 20 which forms a receptacle for, as discussed below, a cable conductor. The tubular wall 20 has a jaw portion end 21 and a receiving end 22.

The jaw portion 18 together, as seen in FIG. 1, with a second jaw portion 23 connected to the second lever 14, clamps onto a battery terminal or other type of electrode or electrical connection point (not shown).

Figure 3:
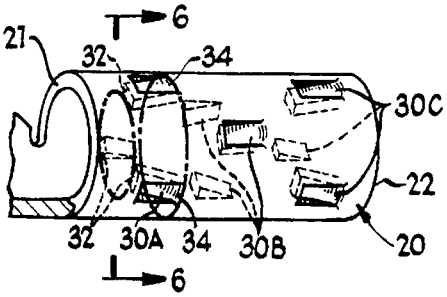
FIG. 3 is an fragmentary perspective view in partial section of a portion of the attachment device of FIG. 2.

Referring to FIG. 2, a cable 24 includes a cable conductor 26, which may be a bundle of conductor wires, the majority of which is surrounded by an insulating material 28. A portion of the cable conductor 26 extends beyond the end of the insulating material 28 and is disposed and retained within the tubular wall 20 by a plurality of generally rectangular fingers 30 extending radially inwardly from the tubular wall 20. The fingers 30 are axially located along the tubular wall 20 in three adjacent groups **30*a*, 30*b*, 30*c*. The fingers in group 30*a* are axially located closest to jaw portion 18, the fingers in group 30*c* are axially located the furthest from jaw portion 18 and the fingers in group 30*b* are located axially between the fingers 30 in groups 30*a* and 30*c*. Referring also to FIG. 3, each finger 30 has a gripping end 32 nearest jaw portion end 21 for retaining the cable conductor 26 and a base end 34 nearest receiving end 22 from which the fingers 30 begin to extend inwardly from the tubular wall 20. The gripping ends 32 of the fingers 30 in a group of fingers lie substantially in a common plane (perpendicular to the longitudinal axis of the tubular wall 20); similarly, the base ends 34 of the fingers 30 in a group lie substantially in a common plane. Thus, the gripping ends 32 and the base ends 34 of each group 30*a–c* define two imaginary circles, shown in phantom in FIG. 3. The circle defined by the base ends 34 has a greater diameter than the circle defined by the gripping ends 32. Each group of fingers 30*a–c* include three fingers 30 which are equidistantly spaced about the circumference of the tubular wall 20. Each finger 30** in a group is therefore about 120 degrees away from an adjacent finger in the group.

Figure 6:
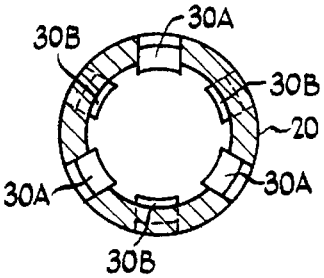
FIG. 6 is an enlarged sectional view taken generally along the line 6—6 in FIG. 3.

Preferably, the fingers 30 of each group are circumferentially disposed about the tubular wall 20 such that they are circumferentially staggered with respect to the fingers of adjacent groups. For example, as best seen in FIG. 6, each finger of group 30*b* is disposed circumferentially midway between two adjacent fingers of adjacent axial group 30*a*. Similarly, as best seen in FIG. 2, each finger in group 30*a* has the same circumferential location along the tubular wall 20 position as a finger in group 30*c*, and each finger in each of groups 30*a* and 30*c* is disposed circumferentially midway between two adjacent fingers in group 30*b*. This finger positioning forms a helical or spiral pattern, such that each finger 30 is closest in the axial direction to another finger 30 which has a different circumferential position. For example, as seen in FIG. 2, the closest finger to finger 30*a*' in the axial direction is finger 30*b*'.

The helical finger pattern shown in FIGS. 2, 3 and 6 allows the cable conductor 26 to be easily inserted into the tubular wall 20 and securely retained therein. The cable conductor 26 is simply inserted by forcing the cable conductor 26 in a straight line into the receiving end 22 of tubular wall 20. The cable conductor 26 which has an outside diameter substantially equal to the inside diameter of the tubular wall 20 deflects the fingers 30 upward towards the outer surface of the tubular wall 20 as it is forced axially and inserted into the tubular wall 20. The gripping ends 32 of the fingers 30 contact and grip the cable conductor 26 with a radial force resulting from deflection of fingers 30 and thus prevent the cable conductor 26 from being pulled out of the receiving end 22 of the tubular wall 20.

After the cable conductor 26 is inserted into the tubular wall 20, it cannot be pulled straight out without applying a pulling force much greater than the force necessary to push in or insert the cable conductor 26 into the tubular wall 20. Thus, in a test of two cable attachment devices made substantially in accordance with the cable attachment device 16 shown in FIGS. 1–3, the first cable attachment device had an inside diameter of about 0.315 inches and a wall thickness of 0.059 inches and the fingers were bent inwardly from the outer surface of the tubular wall 20 a distance of between about 0.024 to about 0.026 inches. A force of about 83.9 pounds was needed to insert a cable conductor (coated with solder) having a diameter of slightly less than 0.315 inches and made of AISI 1144 steel having a hardness of 28–30 Rc. The force needed to remove the cable conductor in a straight line from the cable attachment device was much greater and was about 154.8 pounds.

Similar results were found with the second cable attachment device which was substantially identical to the first cable attachment device, except that it had a 0.029 inch wall thickness and fingers that were bent inward from the outer surface of the tubular wall 20 about 0.020 inches. To insert a cable conductor, having the same characteristics as described above, into the tubular wall 20 required a force of about 24.9 pounds. To remove the cable conductor required a much greater force of about 75.0 pounds.

It has been found, as seen with the above two cable attachment device samples, that a greater force is required to pull out the cable conductor the greater depth that the fingers 30 are bent inwardly and the greater the thickness of the tubular wall 20 (and the fingers 30).

In addition to providing the ability to strongly retain the cable conductor 26 within the tubular wall 20, the cable attachment device 16 also allows the cable conductor 26 to be removed and replaced if it becomes damaged without destroying the cable attachment device 16. To remove the cable conductor 26 from the tubular wall 20, the cable 24 along with the cable conductor 26 are rotated at the same time force is applied to pull the cable conductor 26 out of the tubular wall 20. This simultaneous rotation and pulling, along with the helical pattern of the fingers 30, causes helical indentations to be formed on the cable conductor 26 and allows the cable conductor 26 to be removed or "screwed out" of the tubular wall 20. A new cable conductor 26 can then be inserted as described above.

Figure 4:
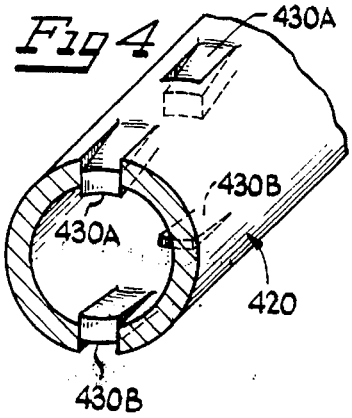
FIGS. 4 and 5 are enlarged, fragmentary, perspective views, partially in cross section, of alternative cable attachment devices, illustrating alternative patterns of inwardly facing fingers about the circumference of the tubular wall used to retain a cable in the device.
Figure 5:
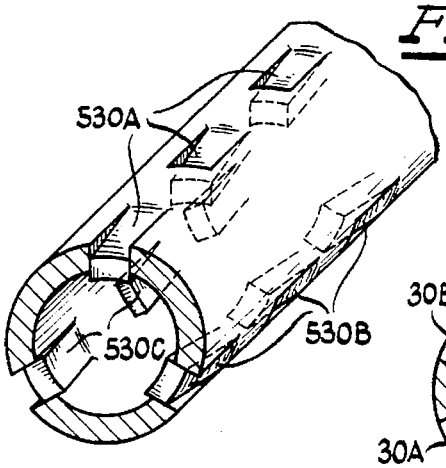

The helical pattern of the fingers 30 shown in FIGS. 2, 3 and 6 is preferred over alternative finger patterns such as those shown in FIGS. 4 and 5, where the closest finger in the axial direction to each finger is disposed substantially at the same circumferential position on the tubular wall. For example, as seen in FIG. 4, a cable attachment device 416 includes a tubular wall 420 that has two groups (or lines) 430*a* and 430*b* of fingers. The fingers in group 430*a* are axially aligned one behind the other at a first circumferential location along the tubular wall 420, while the fingers in group 430*b* are axially aligned at a second circumferential location diametrically opposite the first location.

Similarly, as seen in FIG. 5, cable attachment device 516 has three equiangularly spaced groups of axially aligned fingers 530*a*, 530*b* and 530*c*.

The helical pattern of FIGS. 2–3 and 6 is preferred because it retains the cable conductor 26 more strongly within the tubular wall 20 (i.e. more force is required to pull out the cable conductor 26) than the patterns shown in FIGS. 4 and 5. Also, since the fingers 30 are circumferentially offset in the axial direction, the helical pattern does not tend to weaken the tubular wall 20 along an axial line as much as if the fingers 30 were all in a straight axial line, as seen in FIGS. 4 and 5, and not circumferentially offset.

Figure 7:
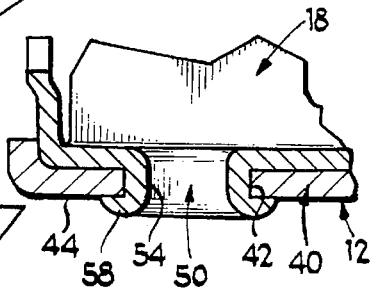
FIG. 7 is an enlarged, fragmentary sectional view taken generally along the line 7—7 in FIG. 2.

Referring to FIG. 7, first jaw portion 18 is uniquely connected to the first lever 12. The first lever 12 includes a first wall 40 which has a first aperture 42 and a first outer surface 44. Jaw portion 18 includes a tubular projection 50 which has a first portion 54 with an outside diameter substantially equal to or less than the inside diameter of the first aperture 42 so that an interference fit can be created between the first portion 54 and the aperture 42. Tubular projection 50 also includes a seating portion 58 created during manufacture which has a larger outside diameter than the first aperture 42 and which further secures and prevents the jaw portion 18 from moving closer to or further from the first wall 40 of the first lever 12. The second jaw portion 23 is connected to the second lever 14 in the same or similar manner.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In combination, an attachment apparatus; and a multi-stranded booster cable conductor having an outside diameter, the attachment apparatus including:

a generally tubular wall having an axis and defining a receptacle for receiving the multi-stranded booster cable conductor and having an inside diameter slightly greater than the outside diameter of the cable conductor; and a plurality of fingers circumferentially and axially spaced about the wall and oriented to grip and retain the multi-stranded booster cable conductor within the receptacle, wherein each finger is closest in a direction parallel to the axis to another finger disposed at a different circumferential position on the wall and includes a base end connected to the wall and a free distal gripping end disposed closer to the axis of the tubular wall than any other portion of the finger.

2. The apparatus of claim 1, further comprising a third set of fingers disposed at a third axial position along the wall.

3. The apparatus of claim 1, wherein the tubular wall has a first end for receiving the cable conductor and a second end, and each finger has a base end connected to the wall and a gripping end disposed at a greater axial distance from the first end than is the base end, wherein the force necessary to insert the cable conductor into the receptacle in an axial direction from the first end to the second end is much less than the force necessary to remove the cable from the receptacle in an axial direction from the second end to the first end.

4. The apparatus of claim 1, further comprising a jaw portion integral with the receptacle for making an electrical connection with an associated terminal.

5. The apparatus of claim 1, wherein the plurality of fingers includes first and second sets of circumferentially spaced fingers, the sets extending radially inwardly from the wall and disposed, respectively, at first and second axial positions along the wall, wherein each of the fingers of the first set of fingers is at a different circumferential position from each of the fingers of the second set of fingers.

6. The apparatus of claim 5, wherein the fingers of the first set of fingers are generally equidistantly spaced from one another about the circumference of the wall and the fingers of the second set of fingers are generally equidistantly spaced from one another about the circumference of the wall.

7. The apparatus of claim 6, wherein each of the first and second sets of fingers has the same number of fingers and each of the fingers of the second set of fingers is substantially centrally disposed circumferentially between two adjacent fingers of the first set of fingers.

8. The apparatus of claim 7, wherein each of the first and second sets of fingers includes at least three fingers and wherein each finger is generally rectangular in shape.

9. A booster cable and clamp combination comprising:

a first lever;

a second lever pivotally connected to the first lever;

a cable having a multi-stranded booster cable conductor with an outside diameter; and a cable attachment apparatus connected to the first lever, the attachment apparatus including a generally tubular wall having an axis and defining a receptacle disposed about the multi-stranded booster cable conductor and having an inside diameter slightly greater than the outside diameter of the multi-stranded booster cable conductor, and a plurality of fingers circumferentially and axially spaced about the wall and projecting radially inwardly therefrom in engagement with the cable conductor, wherein each finger is closest in a direction parallel to the axis to another finger disposed at a different circumferential position on the wall, the fingers collectively applying to the multi-stranded booster cable conductor a first retention force in a first axial direction and a second retention force in a second axial direction, wherein the first retention force is greater than the second retention force.

10. The apparatus of claim 9 wherein the plurality of fingers includes first and second sets of circumferentially spaced fingers, the sets extending radially inwardly from the wall and disposed, respectively, at first and second axial positions along the wall and which grip and retain the cable within the receptacle, wherein each of the fingers of the first set of fingers is at a different circumferential position from each of the fingers of the second set of fingers.

11. The combination of claim 10, further comprising a third set of fingers disposed at a third axial position along the wall.

12. The combination of claim 10, further comprising a jaw portion integral with the receptacle for making an electrical connection with an associated terminal, wherein the first lever has a bore and the jaw portion includes a tubular connector that passes through the bore for connecting the attachment apparatus to the first lever.

13. The combination of claim 10, wherein the fingers of the first set of fingers are generally equidistantly spaced from one another about the circumference of the wall and the fingers of the second set of fingers are generally equidistantly spaced from one another about the circumference of the wall.

14. The combination of claim 13, wherein each of the first and second sets of fingers has the same number of fingers and each of the fingers of the second set of fingers is substantially centrally disposed circumferentially between two adjacent fingers of the first set of fingers.

15. The combination of claim 13, wherein each finger is generally rectangular in shape and each of the first and second sets of fingers includes at least three fingers.

16. In combination, a jaw and cable attachment apparatus; and a multi-stranded booster cable conductor having an outside diameter, the attachment apparatus including:

a jaw portion for making an electrical connection with an associated terminal;

a generally tubular wall having an axis and forming a receptacle integral with the jaw portion for receiving the multi-stranded booster cable conductor and having an inside diameter slightly greater than the outside diameter of the multi-stranded booster cable conductor; and first and second sets of circumferentially spaced fingers extending radially inwardly from the wall and oriented to grip and retain the multi-stranded booster cable conductor within the receptacle and disposed, respectively, at first and second axial positions along the wall, wherein each of the fingers of the first set of fingers is at a different circumferential position than each of the fingers of the second set of fingers, the first and second sets of fingers collectively applying to the multi-stranded booster cable conductor a first retention force in a first axial direction and a second retention force in a second axial direction, wherein the first retention force is greater than the second retention force.

17. The apparatus of claim 16, wherein the fingers of the first set of fingers are generally equidistantly spaced from one another about the circumference of the wall and the fingers of the second set of fingers are generally equidistantly spaced from one another about the circumference of the wall.

18. The apparatus of claim 16, further comprising a third set of fingers disposed at a third axial position along the wall.

19. The apparatus of claim 16, wherein each of the first and second sets of fingers has the same number of fingers and each of the fingers of the second set of fingers is substantially centrally disposed circumferentially between two adjacent fingers of the first set of fingers.

20. The apparatus of claim 18, wherein each of the first and second sets of fingers includes at least three fingers.

* * * * *

UNITED STATES PATENT AND TRADEMARK OFFICE
CERTIFICATE OF CORRECTION

PATENT NO. : 5,634,814

DATED : June 3, 1997

INVENTOR(S) : Bert Krivec

It is certified that error appears in the above-identified patent and that said Letters Patent is hereby corrected as shown below: On title page, item

[56] References Cited - U.S. Patent Documents, the following U.S. patents should be added:

| | | |
|---|---|---|
| --2,603,679 | 7/1952 | Pavlinetz |
| 2,964,727 | 12/1960 | Hebeler |
| 3,453,587 | 7/1969 | Neidecker |
| 3,577,117 | 5/1971 | Bruetsch |
| 3,609,642 | 9/1971 | Norden |
| 3,688,245 | 8/1972 | Lockshaw |
| 4,080,033 | 3/1978 | Deal |
| 4,179,583 | 12/1979 | Sergev |
| 4,673,233 | 6/1987 | Hertelendy |
| 4,961,712 | 10/1990 | Schwenk et al. |
| 5,019,674 | 5/1991 | Greene |
| 5,064,390 | 11/1991 | Umesato et al.-- |

Signed and Sealed this

Second Day of December, 1997

*Attest:*

Bruce Lehman

BRUCE LEHMAN

*Attesting Officer*

*Commissioner of Patents and Trademarks*